US010161170B2

(12) United States Patent
Hotani

(10) Patent No.: US 10,161,170 B2
(45) Date of Patent: Dec. 25, 2018

(54) OPENABLE COVER MECHANISM AND IMAGE FORMING APPARATUS

(71) Applicant: KYOCERA Document Solutions Inc., Osaka (JP)

(72) Inventor: Tomoya Hotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/822,239

(22) Filed: Nov. 27, 2017

(65) Prior Publication Data

US 2018/0148963 A1 May 31, 2018

(30) Foreign Application Priority Data

Nov. 30, 2016 (JP) ..... 2016-232351

(51) Int. Cl.
*G03G 21/16* (2006.01)
*E05D 11/10* (2006.01)
*E05D 5/06* (2006.01)

(52) U.S. Cl.
CPC ..... *E05D 11/1028* (2013.01); *E05D 11/1064* (2013.01); *G03G 21/1633* (2013.01); *E05D 5/06* (2013.01); *E05D 2005/067* (2013.01); *E05Y 2900/608* (2013.01)

(58) Field of Classification Search
CPC ..... G03G 21/1628; G03G 21/1633; G03G 2221/169; E05D 11/1028; E05D 5/06; E05D 2005/067; E05D 11/1064; E05Y 2900/608
See application file for complete search history.

(56) References Cited

U.S. PATENT DOCUMENTS 7,769,322 B2 * 8/2010 Ishihara ..... G03G 21/1628 399/125
8,814,454 B2 * 8/2014 Ito ..... H02G 11/00 399/110
2009/0274502 A1 * 11/2009 Choi ..... H04N 1/00519 399/380
2010/0247137 A1 * 9/2010 Akaike ..... G03G 21/1633 399/110
2011/0197392 A1 * 8/2011 Yamaoka ..... E05D 11/1014 16/82
2017/0067278 A1 * 3/2017 Tomatsu ..... G03G 21/1633
2017/0242391 A1 * 8/2017 Koyanagi ..... G03G 21/1633

FOREIGN PATENT DOCUMENTS

JP H10-020414 A 1/1998

* cited by examiner

*Primary Examiner* — Sophia S Chen
(74) *Attorney, Agent, or Firm* — Studebaker & Brackett PC

(57) ABSTRACT

An openable cover mechanism includes a shaft section disposed in a casing, a hinge section that swings around the shaft section, a cover that is supported by the hinge section and is openable and closable relative to the casing, and a stopper section supported by the casing. The stopper section includes a contact section that makes contact with the hinge section and an urging section that urges the contact section. The hinge section includes a peripheral surface in an arc shape that makes contact with the contact section, and a raised section that is raised from the first peripheral surface. When the cover moves from a closed position to an open position, the contact section slides along the peripheral surface relative to the peripheral surface and engages with the raised section to fix the cover in the open position.

8 Claims, 7 Drawing Sheets

OPENABLE COVER MECHANISM AND IMAGE FORMING APPARATUS

INCORPORATION BY REFERENCE

The present application claims priority under 35 U.S.C. § 119 to Japanese Patent Application No. 2016-232351, filed on Nov. 30, 2016. The contents of this application are incorporated herein by reference in their entirety.

BACKGROUND

The present disclosure relates to openable cover mechanisms and image forming apparatuses.

An existing openable cover mechanism includes an openable cover, a rotary shaft, a latching member, a pin, a guide groove, and a wall surface. The wall surface pivotably supports the rotary shaft. The rotary shaft supports a base end of the openable cover. The openable cover opens and closes around the rotary shaft. The latching member has a rectangular shape. A base end of the latching member is swingably supported by a top end of the openable cover. The pin is disposed in a tip of the latching member. The guide groove is formed in the wall surface. The openable cover has the pin which moves along a guide groove, and thus moves to an open or closed position. The guide groove is configured so that the openable cover does not move into the closed position by the weight thereof when the openable cover is in the open position.

SUMMARY

An openable cover mechanism according to an aspect of the present disclosure is disposed on a casing. The openable cover mechanism includes a shaft section, a hinge section, a cover, and a stopper section. The shaft section is disposed in the casing. The hinge section swings around the shaft section. The cover is supported by the hinge section and is openable and closable relative to the casing. The stopper section is supported by the casing. The stopper section includes a contact section which moves toward the hinge section and makes contact therewith, and an urging section which urges the contact section toward the hinge section. The hinge section includes an arc-shaped first peripheral surface which makes contact with the contact section, and a raised section which is raised from the first peripheral surface. When the cover moves from a closed position to an open position, the contact section slides along the first peripheral surface relative to the first peripheral surface and engages with the raised section to fix the cover in the open position.

An image forming apparatus according to an aspect of the present disclosure includes an image forming section, a casing, and the openable cover mechanism. The image forming section forms an image on a recording medium. The casing houses the image forming section. The openable cover mechanism is disposed on the casing.

DETAILED DESCRIPTION

Hereinafter, embodiments of the present disclosure will be described with reference to the drawings. However, the present disclosure is not limited to the following embodiments. Note that within the drawings, same or equivalent sections are referred to with the same reference numbers and descriptions thereof are not repeated.

First Embodiment

Figure 1:
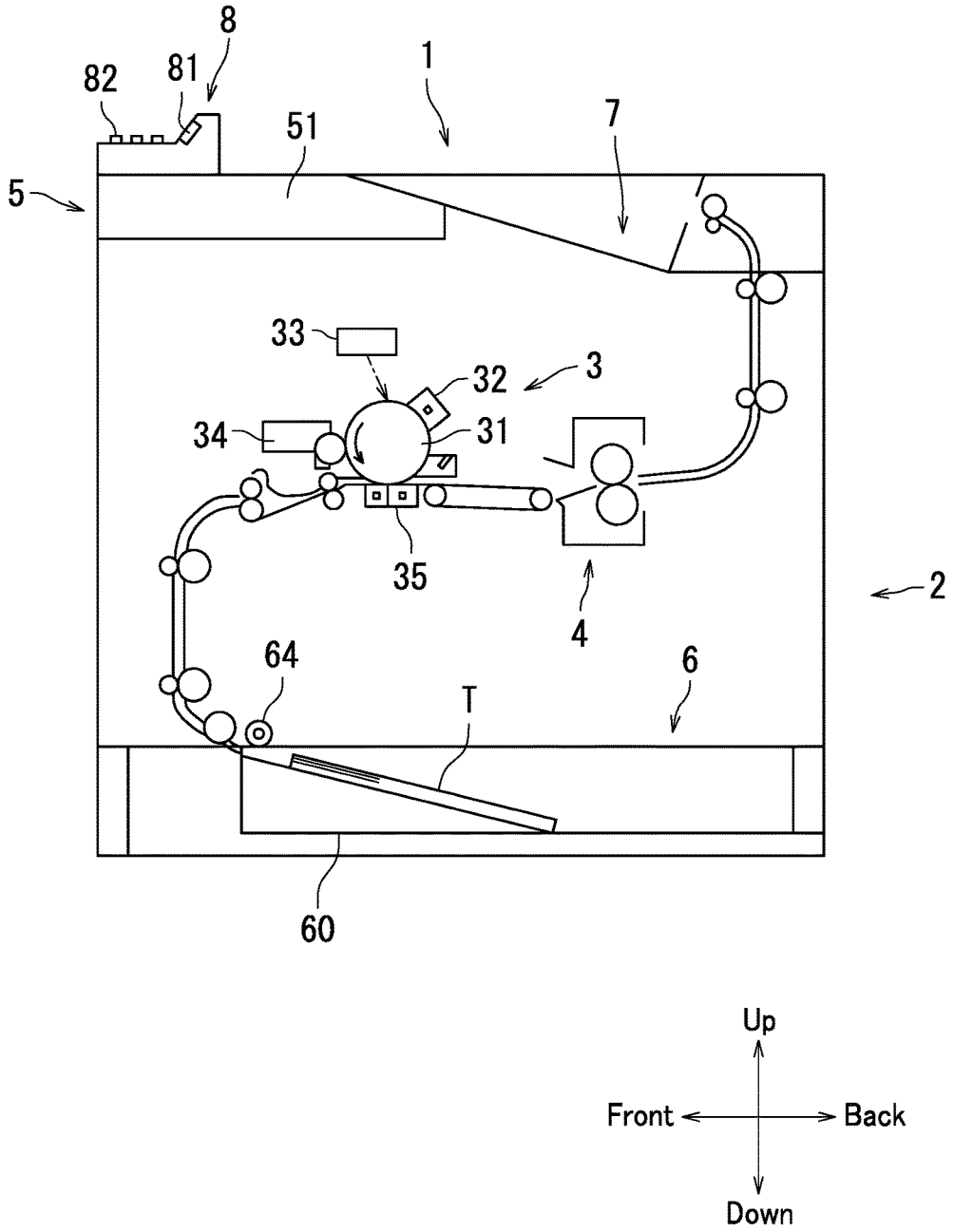
FIG. 1 is a diagram illustrating a configuration of an image forming apparatus according to a first embodiment of the present disclosure.

FIG. 1 is a diagram illustrating a configuration of an image forming apparatus 1 according to a first embodiment of the present disclosure. As illustrated in FIG. 1, the image forming apparatus 1 of the first embodiment is a printer. Note that the image forming apparatus 1 may also be a copier, a facsimile machine, or a multifunction peripheral. A multifunction peripheral, for example, has at least two of the following functions: a copy function, a printer function, and a facsimile machine function.

The image forming apparatus 1 includes a casing 2, an image forming section 3, a fixing section 4, an openable cover mechanism 5, a paper feed section 6, an ejection section 7, and an operating panel 8. The casing 2 has an approximately rectangular parallelepiped box shape. The casing 2 houses the image forming section 3, the fixing section 4, and the paper feed section 6. The casing 2 supports the openable cover mechanism 5. In the present embodiment, the openable cover mechanism 5 is disposed on an upper end of the casing 2. The openable cover mechanism 5 includes a cover 51 that is openable and closable relative to the casing 2.

The operating panel 8 is arranged on an upper surface of the cover 51. The operating panel 8 includes a display section 81 and an operation section 82. The display section 81 is, for example, a liquid-crystal display with a touch panel function. The liquid-crystal display displays a state of the image forming apparatus 1 and various messages. The liquid-crystal display also displays a function setting screen and soft keys for executing character input and the like.

The operation section 82 has a start key and hard keys in the form of a numeric keypad. A user, for example, indicates an execution start of respective functions in the image forming apparatus 1 via the start key. The user also, for example, inputs the number of copies for printing and the like to the image forming apparatus 1 via the numeric keypad.

In FIG. 1, a front of the image forming apparatus 1 is defined as a side on which the user normally operates the operating panel 8, thus defining a front-back direction (first direction). A left of the image forming apparatus 1 is defined as a left-hand side of the user when the user is facing the operating panel 8 from the front, thus defining a left-right direction. An up-and-down direction (second direction) is defined as a direction orthogonal to the front-back and left-right directions.

The paper feed section 6 is arranged in a lower portion of the casing 2. The paper feed section 6 includes a paper feed cassette 60 and a paper feed roller 64. The paper feed cassette 60 can house multiple sheets of paper T. The paper feed roller 64 retrieves an uppermost sheet of the paper T one at a time. The retrieved paper T is conveyed toward the image forming section 3.

The paper T is an example of a recording medium according to an aspect of the present disclosure. The paper T is plain paper, copy paper, recycled paper, thin paper, thick paper, glossy paper, or overhead projector (OHP) transparency, for example. The paper T is conveyed from the paper feed section 6 to the ejection section 7 along a predetermined paper conveyance path.

The image forming section 3 forms a toner image on the paper T. The image forming section 3 is arranged downstream from the paper feed section 6 on the paper conveyance path. The image forming section 3 includes a photosensitive drum 31, a charger 32, an exposure section 33, a development section 34, and a transfer section 35.

The charger 32 charges the photosensitive drum 31 to a predetermined potential. Based on image data, the exposure section 33 outputs a laser beam toward the photosensitive drum 31. As a result, an electrostatic latent image is formed on the peripheral surface of the charged photosensitive drum 31. The development section 34 provides toner to the photosensitive drum 31 and develops the electrostatic latent image. As a result, a toner image is formed on the peripheral surface of the photosensitive drum 31. The transfer section 35 transfers the toner image formed on the peripheral surface of the photosensitive drum 31 to the paper T.

The fixing section 4 is arranged downstream from the image forming section 3 on the paper conveyance path. The fixing section 4 applies heat and pressure to the paper T with the toner image transferred thereon, thereby fixing the toner image to the paper T. The paper T with the toner image fixed thereon is then ejected by the ejection section 7.

Figure 2:
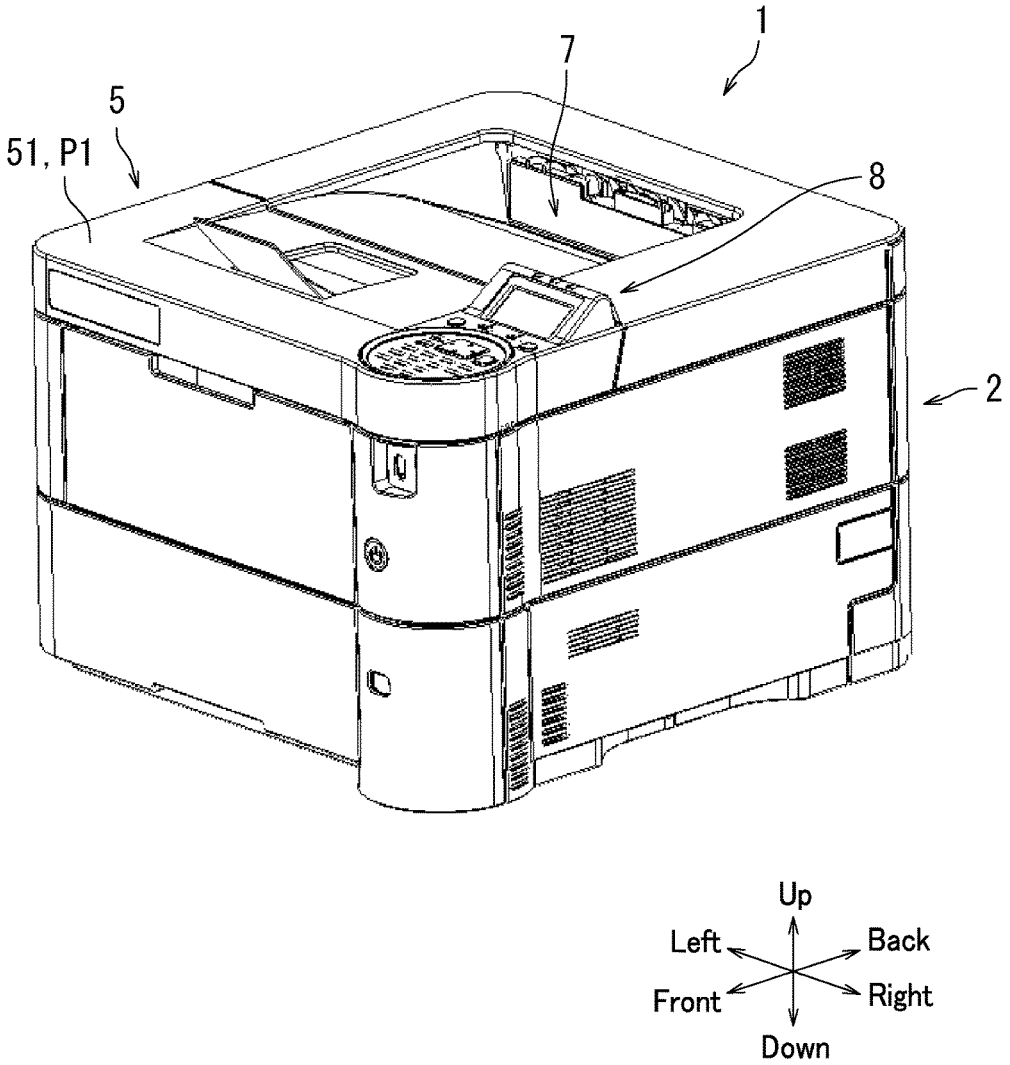
FIG. 2 is a perspective view illustrating the image forming apparatus according to the first embodiment of the present disclosure.
Figure 3:
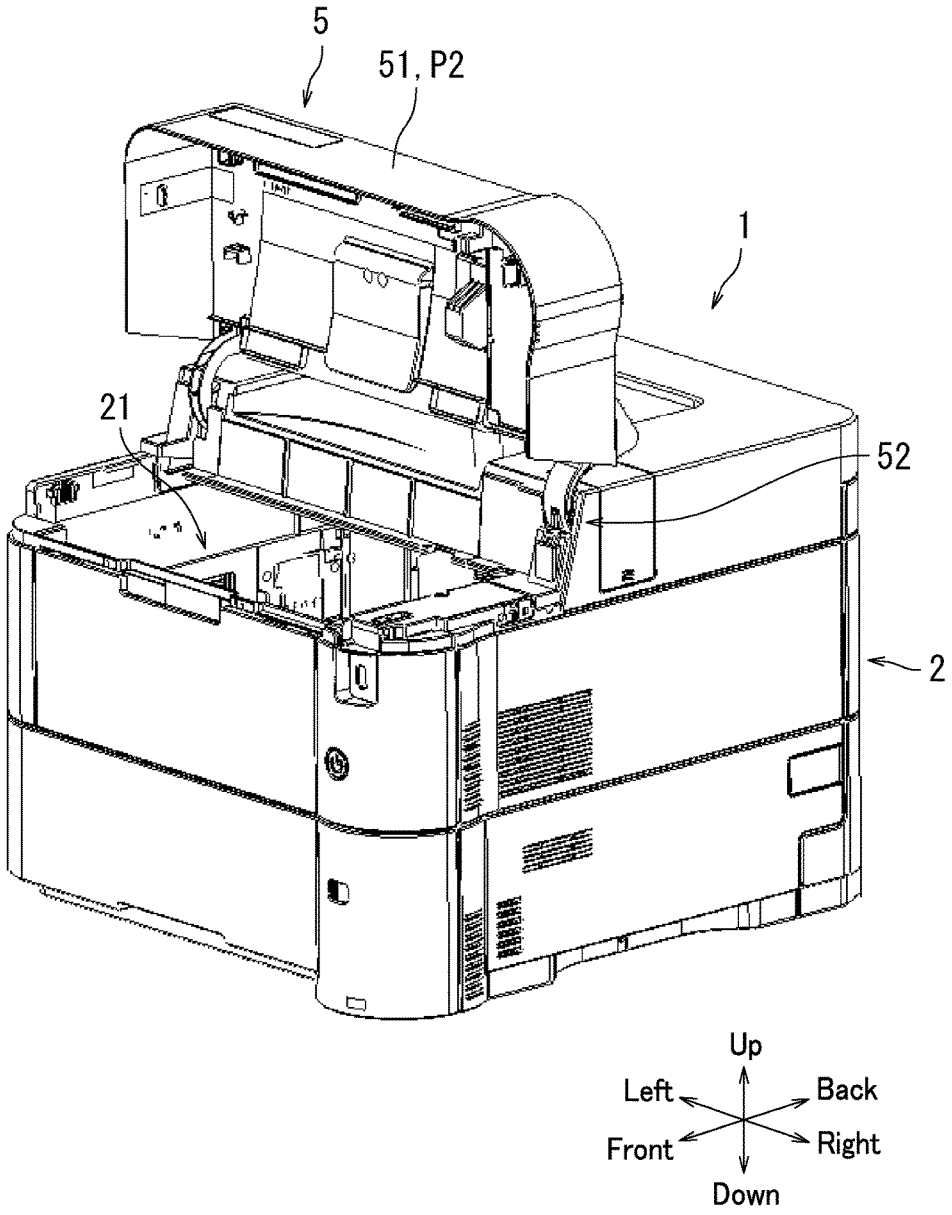
FIG. 3 is a perspective view illustrating the image forming apparatus according to the first embodiment of the present disclosure.

Next, the openable cover mechanism 5 will be described with reference to FIGS. 2 and 3. FIGS. 2 and 3 are perspective views illustrating the image forming apparatus 1 from FIG. 1. In the image forming apparatus 1 illustrated in FIG. 2, the cover 51 is in a closed position P1. In the image forming apparatus 1 illustrated in FIG. 3, the cover 51 is in an open position P2.

The openable cover mechanism 5 further includes a support section 52. The cover 51 is held fast to the casing 2 via the support section 52. The casing 2 rotatably supports the cover 51 via the support section 52. The support section 52 supports a base end of the cover 51. The base end of the cover 51 is a rear end of the cover 51 when the cover 51 is in the closed position P1. The cover 51 is openable and closable in the up-and-down direction pivoting on the base end (rear end) thereof. That is, the up-and-down direction is a direction in which the cover 51 moves between the closed and open positions P1 and P2.

The cover 51 closes an opening 21 of the casing 2 when in the closed position P1. The cover 51 also opens the opening 21 of the casing 2 toward the outside when in the open position P2. The user or a worker such as a service person, for example, opens and closes the cover 51. The cover 51 is moved from the closed position P1 to the open position P2 during maintenance such as removing a paper jam, for example.

Figure 4A:
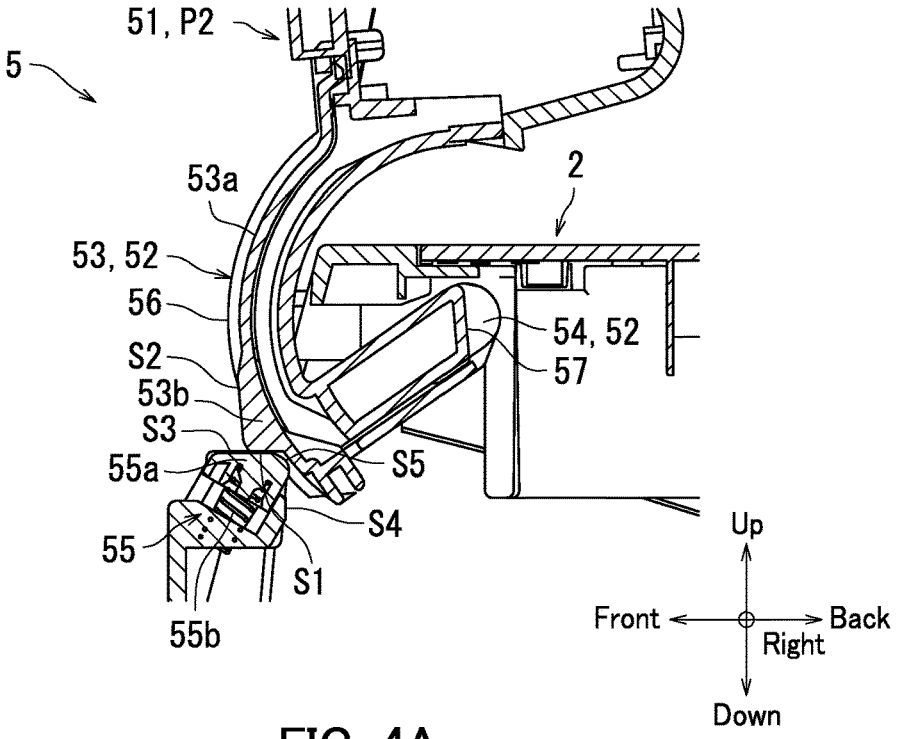
FIG. 4A is a cross-sectional view illustrating a portion of an openable cover mechanism according to the first embodiment of the present disclosure.

Next, the openable cover mechanism 5 will be further described with reference to FIG. 4A. FIG. 4A is a cross-sectional view illustrating a portion of the openable cover mechanism 5. The cover 51 illustrated in FIG. 4A is in the open position P2. As illustrated in FIG. 4A, the support section 52 includes a hinge section 53 and a shaft section 54. The openable cover mechanism 5 further includes a stopper section 55.

The hinge section 53 connects to the base end (rear end) of the cover 51 and extends therefrom. The hinge section 53 has a bent shape when viewed from a side. In the present embodiment, the hinge section 53 has an approximate L-shape when viewed from the side. The hinge section 53 includes a curved portion 56 and a protrusion 57. The curved portion 56 curves and extends from the base end (rear end) of the cover 51 to a bent position on the hinge section 53. The protrusion 57 protrudes from the bent position on the hinge section 53 toward the inside of the curved portion 56.

The curved portion 56 of the hinge section 53 has an arc shape bulging toward the outside, with the shaft section 54 as a center thereof when viewed from the side. In other words, the curved portion 56 bulges toward the front of the image forming apparatus 1 when the cover 51 is in the open position P2. Note that the hinge section 53 and the cover 51 together can be one element.

The shaft section 54 supports a tip of the protrusion 57 of the hinge section 53. The shaft section 54 extends in the left-right direction of the image forming apparatus 1 and is pivotably supported by the casing 2. The shaft section 54 is also swingably supported relative to the casing 2. Furthermore, the hinge section 53 is swingably supported relative to the casing 2 via the shaft section 54. As a result, the cover 51 opens and closes relative to the casing 2. Note that the shaft section 54 may be fixed to the casing 2. In such a configuration, the shaft section 54 swingably supports the protrusion 57 of the hinge section 53.

The hinge section 53 includes a peripheral surface 53*a*. The peripheral surface 53*a* is an example of a first peripheral surface according to an aspect of the present disclosure. The peripheral surface 53*a* constitutes an outer surface in a radial direction of the curved portion 56 of the hinge section 53 when viewed from the side.

The hinge section 53 further includes a raised section 53*b*. The raised section 53*b* is disposed on the peripheral surface 53*a*. In detail, the raised section 53*b* protrudes from the peripheral surface 53*a* near a tip of the curved portion 56 of the hinge section 53.

The raised section 53*b* includes first and second raised surfaces S1 and S2. The first raised surface S1 is located away from the cover 51 on the first peripheral surface 53*a*. In other words, the first raised surface S1 is on an opposite side from the cover 51. That is to say, the first raised surface S1 is located closer to the tip of the curved portion 56 of the hinge section 53 (base end of the protrusion 57) than the second raised surface S2. The second raised surface S2 is located closer to the cover 51 than the first raised surface S1 on the first peripheral surface 53*a*. In other words, the second raised surface S2 is on a same side as the cover 51. That is to say, the second raised surface S2 is located closer to a base end of the curved portion 56 of the hinge section 53 (rear end of the cover 51) than the first raised surface S1. In the present embodiment, the raised section 53*b* has an approximate triangle shape when viewed from the side. The first raised surface S1 constitutes a slanting surface near the tip of the curved portion 56 of the hinge section 53, in the raised section 53*b*. The second raised surface S2 constitutes a slanting surface near the base end of the curved portion 56 of the hinge section 53, in the raised section 53*b*. A slanting angle of the first raised surface S1 relative to the peripheral surface 53*a* is larger than a slanting angle of the second raised surface S2 relative to the peripheral surface 53*a*. Note that the peripheral surface 53*a* and the raised section 53*b* together can be one element.

The stopper section 55 includes a contact section 55*a* and an urging section 55*b*. The casing 2 supports the contact section 55*a* so that the contact section 55*a* is movable toward the hinge section 53. The contact section 55*a* has a first contact surface S3 extending in the front-back direction, a second contact surface S4 extending in the up-and-down direction, and an arc surface S5 smoothly connecting the first contact surface S3 and the second contact surface S4.

The casing 2 supports the urging section 55*b* so that the urging section 55*b* urges the contact section 55*a* toward the hinge section 53. The urging section 55*b* is an elastic object such as a spring.

Figure 4B:
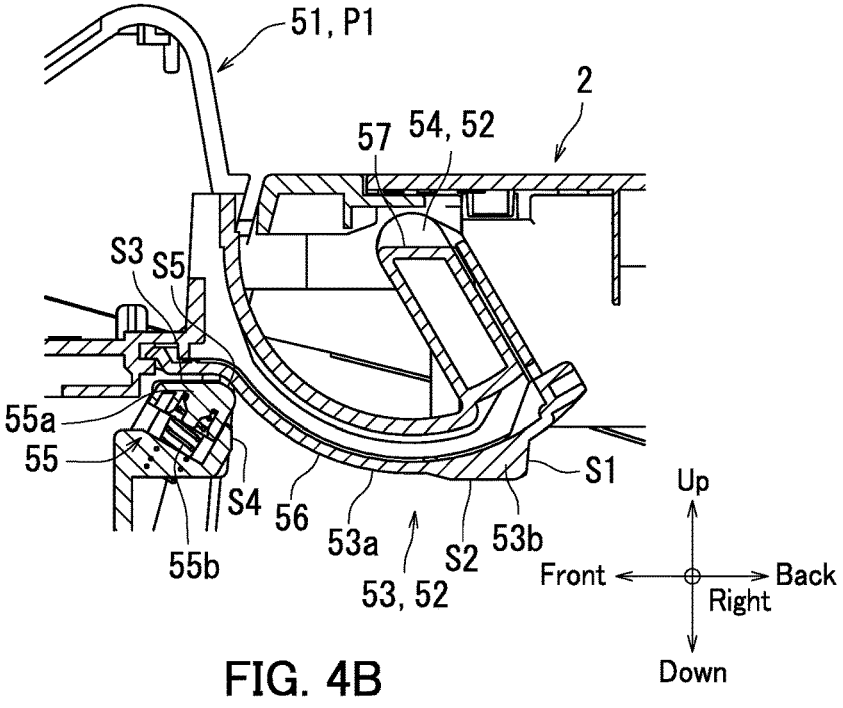
FIG. 4B is another cross-sectional view illustrating a portion of the openable cover mechanism according to the first embodiment of the present disclosure.

Next, an opening and closing operation of the cover 51 will be described with reference to FIGS. 4A and 4B. FIG. 4B is a cross-sectional view illustrating a portion of the openable cover mechanism 5. The cover 51 illustrated in FIG. 4B is in the closed position P1.

As illustrated in FIG. 4B, the arc surface S5 of the contact section 55*a* makes contact with the peripheral surface 53*a* of the hinge section 53 when the cover 51 is in the closed position P1. In detail, the arc surface S5 makes contact with the peripheral surface 53*a* near the base end of the curved portion 56 of the hinge section 53. Note that the first contact surface S3 of the contact section 55*a* may make contact with the cover 51 or a base end of the hinge section 53 when the cover 51 is in the closed position P1, and may support the cover 51 from below.

As illustrated in FIGS. 4A and 4B, the contact section 55*a* slides along the hinge section 53 relative to the hinge section 53 when the cover 51 moves from the closed position P1 to the open position P2 and from the open position P2 to the closed position P1. The peripheral surface 53*a* of the hinge section 53 also slides while making contact with the contact section 55*a* when the cover 51 moves from the closed position P1 to the open position P2 and from the open position P2 to the closed position P1.

The arc surface S5 of the contact section 55*a* slides along the second raised surface S2 of the hinge section 53 relative to the second raised surface S2 after sliding along the peripheral surface 53*a* of the hinge section 53 relative to the peripheral surface 53*a* when the cover 51 moves from the closed position P1 to the open position P2. At this time, urging force of the urging section 55*b* increases and burden for the worker when moving the cover 51 from the closed position P1 to the open position P2 slightly increases. As a result, the worker can know that the cover 51 is about to reach the open position P2 by feeling a change in the operation of the cover 51.

Next, the arc surface S5 of the contact section 55*a* separates from the second raised surface S2 when the cover 51 moves from the closed position P1 to the open position P2, and the contact section 55*a* collides with the peripheral surface 53*a* of the hinge section 53 from the urging force of the urging section 55*b*. The worker can accordingly be given a clicking sensation. As a result, the worker can know that the cover 51 has reached the open position P2 by the addition of the clicking sensation to the feeling of the operation of the cover 51.

The first contact surface S3 of the contact section 55*a* also makes contact with the first raised surface S1 as the cover 51 moves from the closed position P1 to the open position P2, and the contact section 55*a* and the raised section 53*b* engage with each other. As a result, movement from the open position P2 to the closed position P1 due to the weight of the cover 51 is inhibited, and the cover 51 is fixed in the open position P2.

In the image forming apparatus 1 of the present embodiment, the cover 51 can be fixed in the open position P2 without a wall surface having a guide groove formed therein disposed in the cover 51. The openable cover mechanism 5 can accordingly be disposed on the casing 2 through a simple configuration, without harming the outer appearance of the image forming apparatus 1.

Also in the image forming apparatus 1 of the present embodiment, the urging section 55*b* urges the cover 51 toward the open position P2 via the contact section 55*a* when the arc surface S5 of the contact section 55*a* separates from the second raised surface S2 of the raised section 53*b*. The burden for the worker when opening the cover 51 accordingly decreases. As a result, the worker can know that the cover 51 has reached the open position P2 by feeling a change in the operation of the cover 51.

Figure 5:
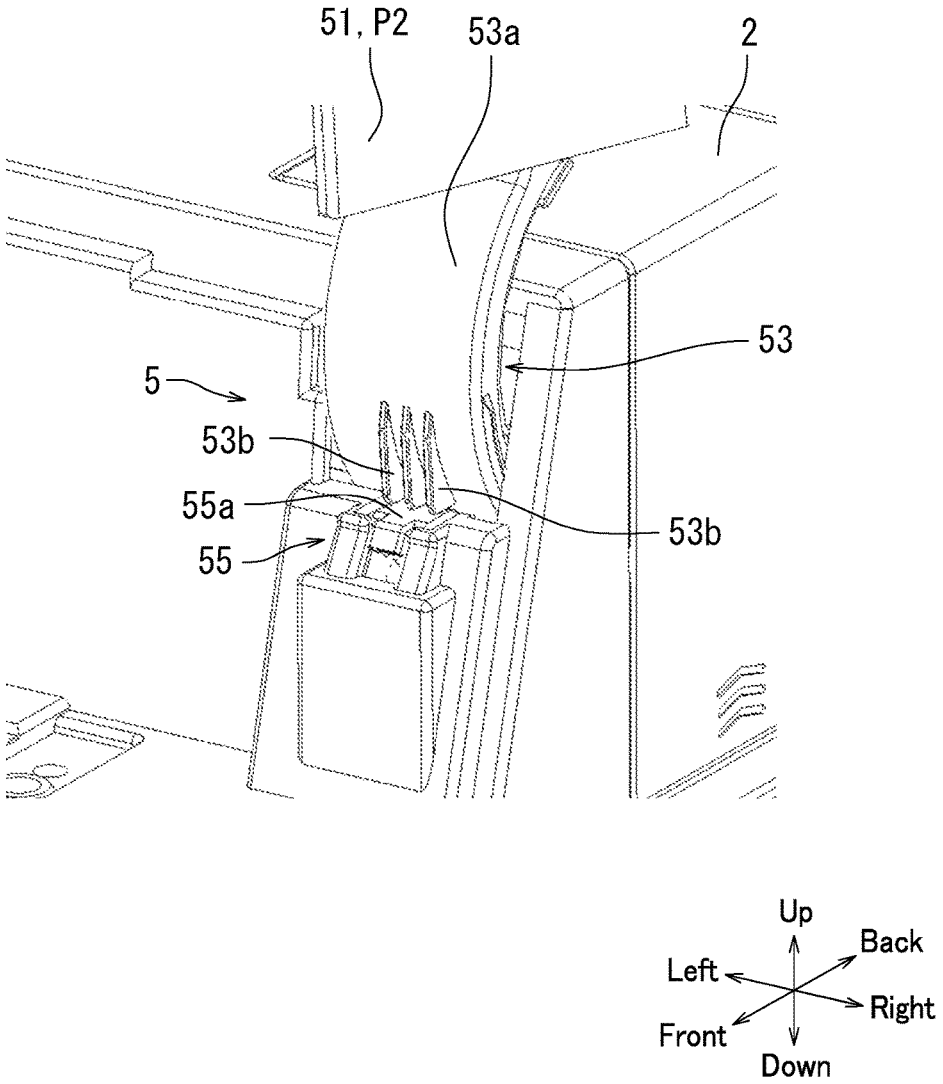
FIG. 5 is an enlarged view illustrating a portion of the openable cover mechanism from FIG. 3.

Next, a configuration including a plurality of raised sections 53*b* will be described with reference to FIG. 5. FIG. 5 is an enlarged view illustrating a portion of the openable cover mechanism 5 from FIG. 3. As illustrated in FIG. 5, a width in the left-right direction of the plurality of raised sections 53*b* is smaller than a width in the left-right direction of the peripheral surface 53*a*. Friction when the raised sections 53*b* and the contact section 55*a* slide on each other is accordingly less than friction when the peripheral surface 53*a* and the contact section 55*a* slide on each other. As a result, the burden for the worker when opening and closing the cover 51 can decrease.

The hinge section 53 includes a plurality of raised sections 53*b* arranged in the left-right width direction of the peripheral surface 53*a*. Stress when the raised sections 53*b* and the contact section 55*a* make contact with each other can be dispersed in the left-right width direction of the contact section 55*a* through the plurality of raised sections 53*b*. As a result, early abrasion of the raised sections 53*b* and the contact section 55*a* can be inhibited by the mutual sliding of the contact section 55*a* and the raised sections 53*b*.

Second Embodiment

Figure 6:
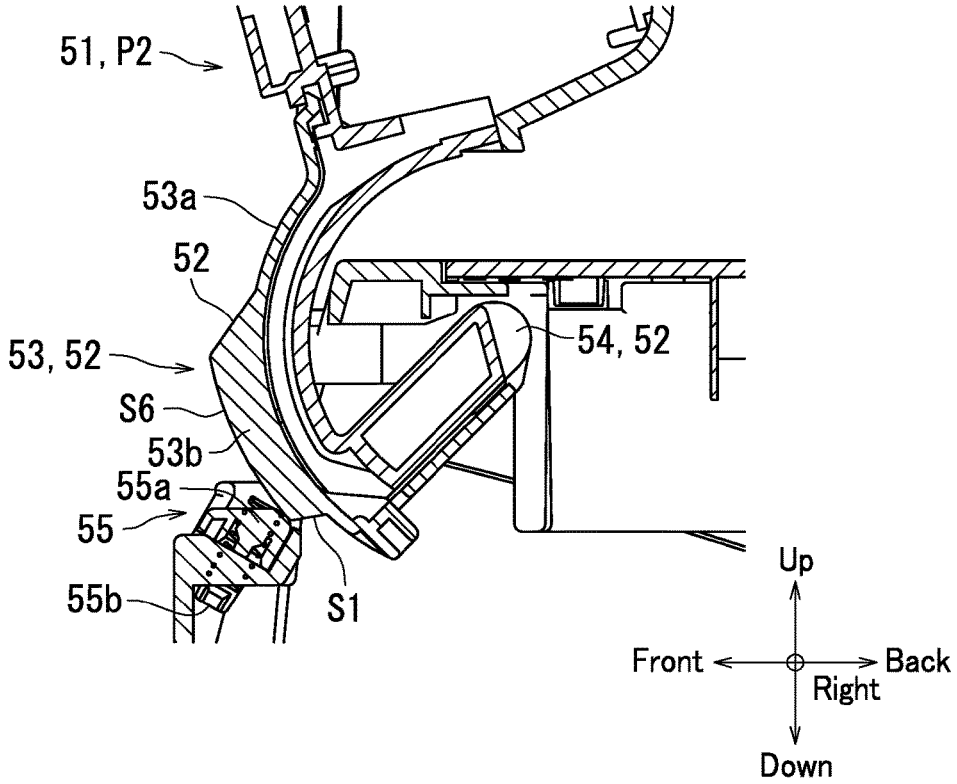
FIG. 6 is a cross-sectional view illustrating a portion of the openable cover mechanism according to a second embodiment of the present disclosure.

The image forming apparatus 1 according to a second embodiment of the present disclosure will be described with reference to FIG. 6. FIG. 6 is a cross-sectional view illustrating a portion of the openable cover mechanism 5 of the second embodiment of the present disclosure. The cover 51 illustrated in FIG. 6 is in the open position P2. The image forming apparatus 1 of the second embodiment differs from the image forming apparatus 1 of the first embodiment in that the raised section 53*b* of the second embodiment further includes a peripheral surface S6 between the first raised surface S1 and the second raised surface S2.

As illustrated in FIG. 6, the raised section 53*b* of the second embodiment is formed so as to extend further toward the base end of the curved portion 56 of the hinge section 53, than the raised section 53*b* of the first embodiment. The peripheral surface S6 is an example of a second peripheral surface according to an aspect of the present disclosure. The peripheral surface S6 has an arc shape bulging toward the outside with the shaft section 54 as a center thereof, when viewed from a side. In other words, the peripheral surface S6 bulges toward the front of the image forming apparatus 1 when the cover 51 is in the open position P2.

A curvature radius of the peripheral surface S6 enlarges toward the second raised surface S2 from the first raised surface S1. The urging force with which the urging section 55*b* urges the contact section 55*a* accordingly increases when the contact section 55*a* slides along the peripheral surface S6 relative to the peripheral surface S6 from the first raised surface S1 toward the second raised surface S2. As a result, movement from the open position P2 to the closed position P1 due to the weight of the cover 51 can be inhibited. The cover 51 is also urged toward the open position P2 by the urging section 55*b* after the contact section 55*a* has passed the second raised surface S2 when the cover 51 moves from the closed position P1 to the open position P2. As a result, the burden for the worker when opening the cover 51 can decrease.

The image forming apparatus 1 according to the first and second embodiments of the present disclosure is previously described with reference to FIGS. 1 to 6. However, the present disclosure is not limited to the above embodiments and can be practiced in various ways within the scope not departing from the gist thereof.

For example, in the embodiments of the present disclosure, the hinge section 53 includes one raised section 53*b* in a circumferential direction on the peripheral surface 53*a*, but the present disclosure is not limited hereto. The hinge section 53 may also include a plurality of raised sections 53*b* in the circumferential direction on the peripheral surface 53*a*.

Figure 7:
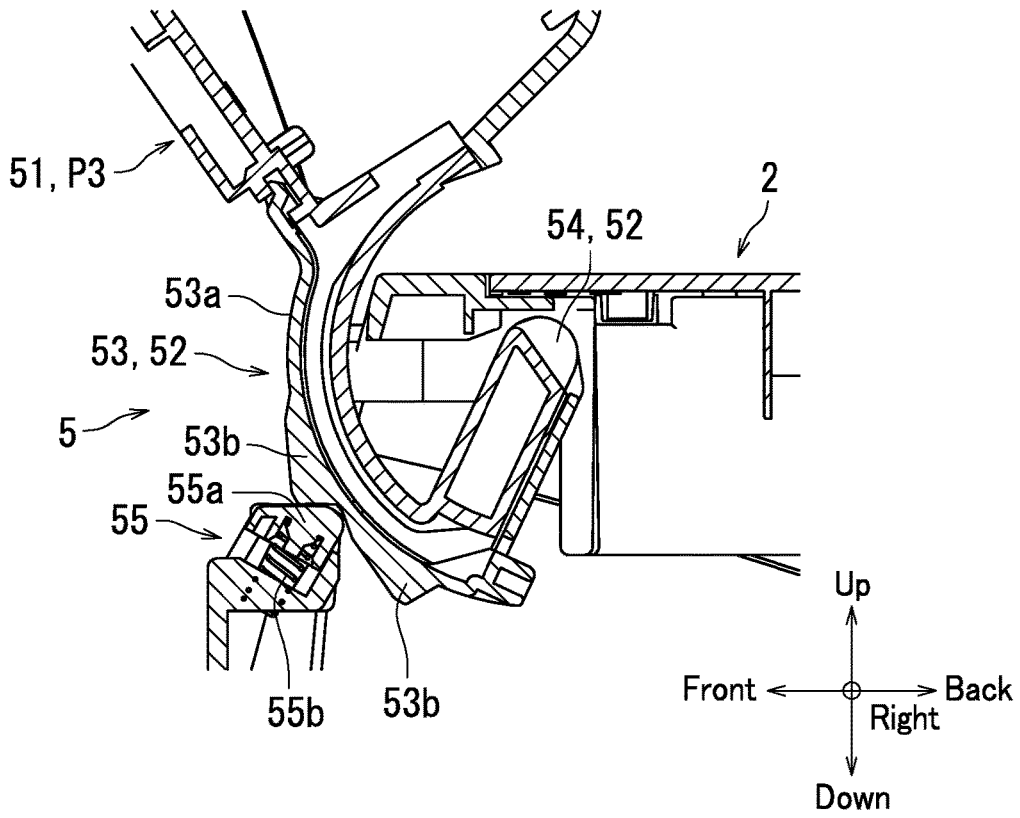
FIG. 7 is cross-sectional view illustrating a portion of the openable cover mechanism according to another embodiment of the present disclosure.

The hinge section 53 according to another embodiment of the present disclosure will be described with reference to FIG. 7. FIG. 7 is a cross-sectional view illustrating a portion of the openable cover mechanism 5 according to the other embodiment of the present disclosure. The cover 51 illustrated in FIG. 7 is in a suspended position P3.

The hinge section 53 illustrated in FIG. 7 includes a plurality of raised sections 53*b*. The plurality of raised sections 53*b* is arranged in a circumferential direction of the peripheral surface 53*a*. As a result, at least one suspended position P3 can be disposed between the closed and open positions P1 and P2 of the cover 51 by the plurality of raised sections 53*b*. The cover 51 is suspended in the suspended position P3 when the cover 51 is opened or closed. As a result, movement from the open position P2 to the closed position P1 due to the weight of the cover 51 can be inhibited.

Note that the respective drawings are schematic illustrations that emphasize elements of configuration in order to facilitate understanding thereof. Dimensions such as thickness and length of each of the elements in the drawings may differ from the actual dimensions thereof for the convenience of drawing preparation. Also note that shapes and the like, described for each of the elements of configuration in the above embodiments, are only examples and are not intended to impose any particular limitations on the elements and can be altered in various ways to the extent that there is no substantial deviation from the effects of the present disclosure.

What is claimed is:

1. An openable cover mechanism for installation on a casing, the openable cover mechanism comprising:
- a shaft section disposed in the casing;
- a hinge section configured to swing around the shaft section;
- a cover that is openable and closable relative to the casing, the cover being supported by the hinge section; and
- a stopper section supported by the casing, wherein
- the stopper section includes:
  - a contact section configured to move toward and make contact with the hinge section; and
  - an urging section configured to urge the contact section toward the hinge section,
- the hinge section includes:
  - a first peripheral surface in an arc shape configured to make contact with the contact section; and
  - a raised section raised from the first peripheral surface, and
- when the cover moves from a closed position to an open position, the contact section slides along the first peripheral surface relative to the first peripheral surface and engages with the raised section to fix the cover in the open position.

2. The cover mechanism according to claim 1, wherein
- the hinge section includes a plurality of the raised sections, and
- the raised sections are arranged in a circumferential direction of the first peripheral surface.

3. The openable cover mechanism according to claim 1, wherein
- the raised section includes a first raised surface located away from the cover on the first peripheral surface and a second raised surface located closer to the cover than the first raised surface on the first peripheral surface, and
- a slanting angle of the first raised surface relative to the first peripheral surface is greater than a slanting angle of the second raised surface relative to the first peripheral surface.

4. The openable cover mechanism according to claim 3, wherein
- the raised section further includes a second peripheral surface between the first raised surface and the second raised surface, and
- the second peripheral surface has a curvature radius that increases from the first raised surface toward the second raised surface.

5. The openable cover mechanism according to claim 3, wherein
- the contact section comprises:
  - a first contact surface extending in a first direction;
  - a second contact surface extending in a second direction; and
  - an arc surface connecting the first contact surface and the second contact surface, and
- the arc surface separates from the second raised surface and the contact section collides with the first peripheral surface when the cover moves from the closed position to the open position.

6. The openable cover mechanism according to claim 1, wherein
- a width of the raised section is smaller than a width of the first peripheral surface.

7. The openable cover mechanism according to claim 1, wherein
- the hinge section includes a plurality of the raised sections, and
- the raised sections are arranged in a width direction of the first peripheral surface.

8. An image forming apparatus, comprising:
- an image forming section configured to form an image on a recording medium;

a casing that houses the image forming section; and the openable cover mechanism according to claim 1, wherein the openable cover mechanism is disposed on the casing.

* * * * *